US008226139B2

(12) United States Patent
Berk

(10) Patent No.: US 8,226,139 B2
(45) Date of Patent: Jul. 24, 2012

(54) LIFTING CLAMP

(75) Inventor: Peter Paul Alexander Berk, Zwolle (NL)

(73) Assignee: The Crosby Group LLC, Tulsa, OK (US)

( * ) Notice: Subject to any disclaimer, the term of this patent is extended or adjusted under 35 U.S.C. 154(b) by 102 days.

(21) Appl. No.: 12/451,149

(22) PCT Filed: Mar. 10, 2008

(86) PCT No.: PCT/NL2008/050137

§ 371 (c)(1),
(2), (4) Date: Jan. 15, 2010

(87) PCT Pub. No.: WO2008/136664

PCT Pub. Date: Nov. 13, 2008

(65) Prior Publication Data

US 2010/0109362 A1 May 6, 2010

(30) Foreign Application Priority Data

May 8, 2007 (NL) ..... 2000636

(51) Int. Cl.
*B66C 1/00* (2006.01)
*B66C 1/48* (2006.01)

(52) U.S. Cl. ..... 294/104; 294/65.5; 294/101; 269/8; 269/95

(58) Field of Classification Search ..... 294/104, 294/101, 901, 65.5, 2; 269/66, 84, 91, 95, 269/228, 8
See application file for complete search history.

(56) References Cited

U.S. PATENT DOCUMENTS

| | | | | |
|---|---|---|---|---|
| 761,282 | A * | 5/1904 | Aires | 294/101 |
| 3,075,664 | A | 1/1963 | Collings | 214/658 |
| 3,659,890 | A * | 5/1972 | Renfroe | 294/104 |
| 3,857,600 | A * | 12/1974 | Hasegawa | 294/104 |
| 4,595,225 | A | 6/1986 | Kemble et al. | |
| 4,834,442 | A * | 5/1989 | Choung | 294/101 |
| 5,232,256 | A * | 8/1993 | Forbes | 294/50.9 |
| 7,156,436 | B2 * | 1/2007 | Nguyen | 294/102.1 |
| 2006/0061112 | A1 * | 3/2006 | Schon | 294/101 |

FOREIGN PATENT DOCUMENTS

EP 1293467 A2 10/2003

* cited by examiner

*Primary Examiner* — Dean Kramer
*Assistant Examiner* — Stephen Vu
(74) *Attorney, Agent, or Firm* — Head Johnson & Kachigian P.C.

(57) ABSTRACT

A lifting clamp for a workpiece such as plate material, comprising a bearing part and a clamping arm which is rotatably connected to the bearing part above said bearing part and at one end is provided with a clamping face for the purpose of clamping a part of the workpiece between the bearing part and the clamping face, and at the other end of the clamping arm is provided with a lifting eye, the bearing part comprising at least one magnet.

8 Claims, 2 Drawing Sheets

LIFTING CLAMP

CROSS-REFERENCE TO RELATED APPLICATION

This is the US National Phase Application of PCT Application No. PCT/NL2008/050137 filed 10 Mar. 2008 which claims priority to Dutch Patent Application No. 2000636 filed 8 May 2007.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention relates to a lifting clamp for clamping a workpiece to be lifted.

2. Description of the Related Art

Such a lifting clamp is disclosed in, inter alia, U.S. Pat. No. 761,282 and U.S. Pat. No. 3,851,358, and the applicant has been putting it on the market for years now. For the horizontal lifting of, for example, metal plates a plurality of lifting clamps at a distance from each other on opposite sides are generally used, as shown, for example, in FIG. 1 of U.S. Pat. No. 815,452.

Furthermore, U.S. Pat. No. 4,595,225 discloses a lifting clamp which is provided with an electromagnet for the purpose of keeping a clamping part open. A problem with this clamp is the positioning of the clamp before the lifting operation. The clamp will grip a workpiece only at the time of lifting; before that, the clamp can fall off or become detached from the workpiece.

The positioning of such lifting clamps, which for heavy workpieces are often made heavy themselves, often cannot be performed by one person. In addition, the lifting clamps can slip off before the start of pulling on the lifting eyes. A clamping arm is often pretensioned by means of a spring or the like in the clamping device. However, in order to ensure reliable clamping, this pretensioning must be considerable, and in the case of large clamps a spring is not sufficient. This means that a lifting clamp is generally made heavier than is strictly necessary for strength and/or a bearing part is long and difficult to handle. There is therefore scope for improvement on these lifting clamps which have been known per se for a long time now.

BRIEF SUMMARY OF THE INVENTION

The object of the invention is to provide an improved lifting clamp.

The object of the invention is furthermore or additionally to provide a lifting clamp which is easy to position.

The object of the invention is furthermore to provide a lifting clamp which in the case of use for substantially horizontal lifting of plates, where the lifting clamp, in combination with a plurality of such lifting clamps, can preferably be used by one person.

To this end, the invention provides a lifting clamp for a workpiece such as plate material, comprising a bearing part and a clamping arm which is rotatably connected to the bearing part above said bearing part and at one end is provided with a clamping face for the purpose of clamping a part of the workpiece between the bearing part and the clamping face, and at the other end of the clamping arm is provided with a lifting eye, the bearing part comprising at least one magnet.

Through the magnet, the lifting clamp is easy to place on workpieces, such as plates or, for example, H-beams and the like which contain iron or are possibly attracted in other ways by magnetic forces.

The lifting clamp according to the invention has the advantage that the bearing part can be made shorter, with the result that usability in connection with the lifting of sections, for example H-beams, is improved.

A further advantage of the lifting clamp according to the invention is that the jaw opening can be made larger in connection with making the device lighter or leaving out a pretensioning spring.

Apart from that, the lifting clamp according to the invention is often used in combination with a plurality of such lifting clamps. This is shown, for example, in U.S. Pat. No. 815,452. Up to four lifting clamps are generally placed at the corner points of a rectangular plate. When that was performed by one person, it did happen that a clamp already placed sometimes slipped off or partially slipped off, which led to dangerous situations. For that reason, several persons, even up to one person per clamp, were often needed. In order to make it possible for one person to place the clamps and to make more secure clamps possible, a magnet was fitted in the clamping face. Since the clamping was found to be so much more secure, it was also found to be possible to reduce the pretension applied to the clamping arm, for example by means of a spring. This makes it easier to position the lifting clamp. It was also found possible to make the clamping arm and the bearing part lighter because of the better clamping before the actual lifting. The clamping arm is heavier near its clamping part than near its lifting eye, so that the clamping arm clamps even without a lifting force being exerted, often in combination with a spring which pretensions the clamping arm. Because of the better clamping, the clamping arm and the bearing part can also be made lighter.

In one embodiment of the lifting clamp the bearing part supports an object or plate to be lifted during the lifting operation.

In one embodiment the at least one magnet is equipped to hold the lifting clamp in place on an object or plate to be lifted before a lifting force is exerted upon the lifting clamp. This means that the lifting clamp can be positioned securely before the lifting force is applied.

In one embodiment of this lifting clamp the magnet is a permanent magnet. This makes the lifting clamp reliable in operation.

In one embodiment of the lifting clamp the bearing part is at least partially magnetized. This means that a metal plate or object is held tightly on the bearing part and the lifting clamp can be positioned and remain in position before a lifting force is exerted upon the lifting clamp. In one embodiment the surface of the bearing part which supports a plate or an object to be lifted is at least partially magnetized. This makes good positioning possible before lifting.

In one embodiment the magnet or a magnet in this case is positioned at or near the center of gravity of the lifting clamp.

In a further embodiment the magnet or a magnet in this case is positioned between an edge of the bearing part and the center of gravity of the lifting clamp. An even more secure preclamping is achieved in this way.

In a further embodiment the bearing part in this case comprises a plurality of magnets.

In a further embodiment the clamping arm in this case is rotatable or pivotable about a pivot pin, the pivot pin being mounted on an arm that extends from the bearing part and extends further above the bearing part.

It should be clear that the various aspects mentioned in this patent application can be combined and can each be considered separately for a divisional patent application.

BRIEF DESCRIPTION OF THE DRAWINGS

An embodiment of a lifting clamp according to the invention is shown in the appended figures, in which.

DESCRIPTION OF THE INVENTION

Figure 1:
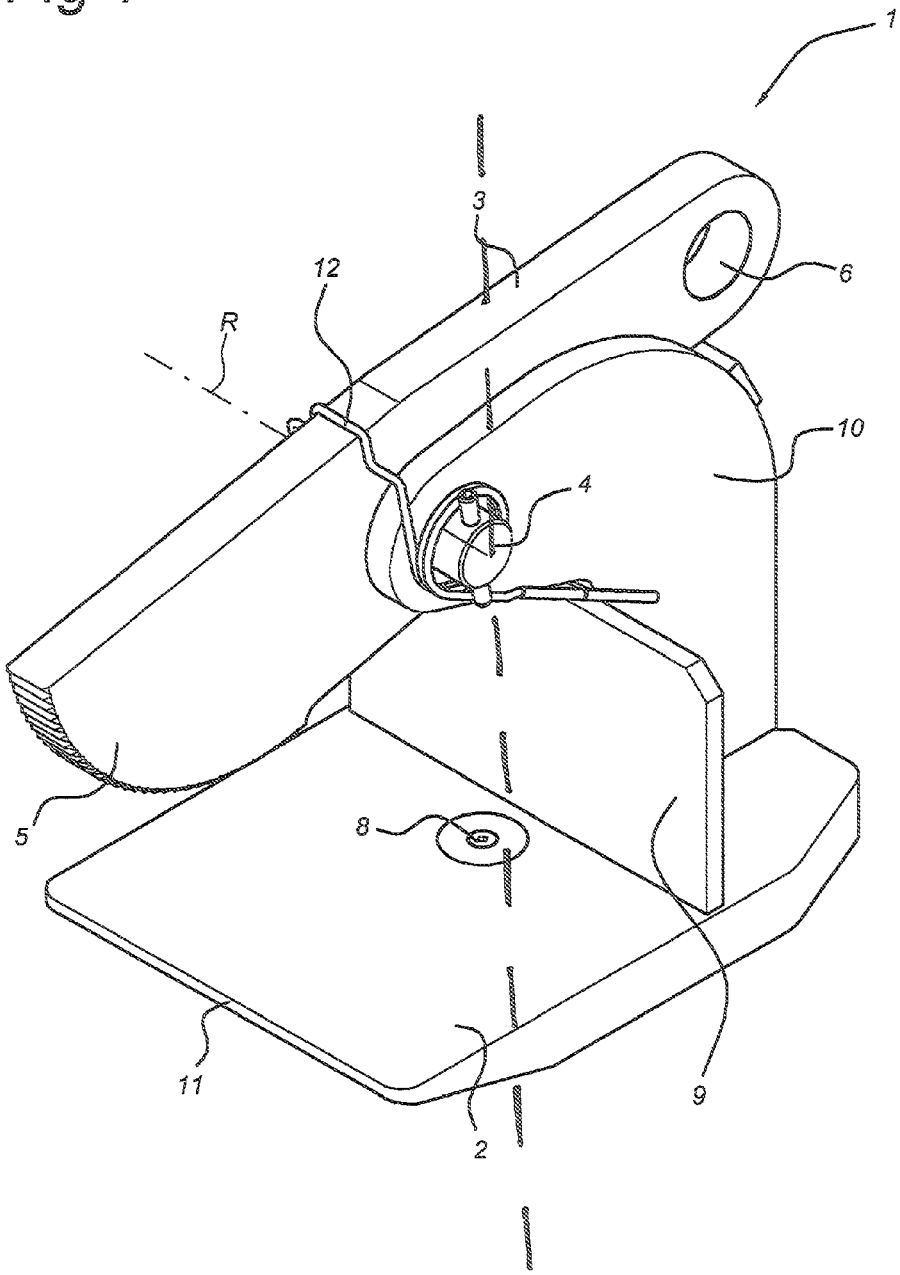
FIG. 1 is a perspective view of an embodiment of a lifting clamp according to the invention.
Figure 2:
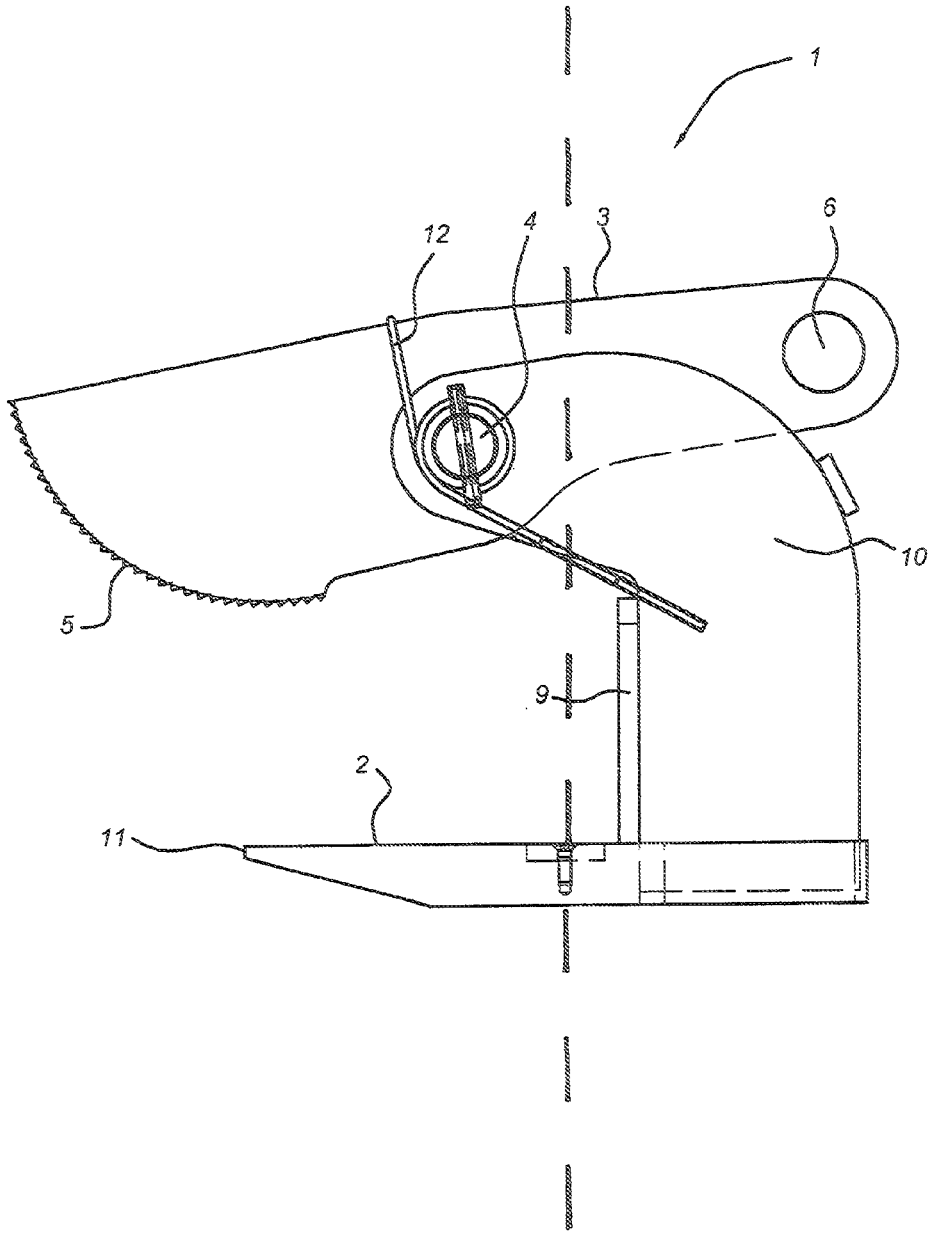
FIG. 2 is a side view of the lifting clamp of FIG. 1.

FIG. 1 shows a lifting clamp 1 which is provided with a bearing part 2, on which a plate piece or another part of a workpiece can rest. Connected to the workpiece 2 is an arm 10, which extends from the bearing part and extends over the bearing face of the bearing part 2. Said arm 10 is provided with a pin 4 on which a clamping arm 3 is mounted so as to rotate about axis of rotation R. Said clamping arm 3 has on one end a lifting eye 6 and on the other end facing the bearing part 2 a clamping face 5. A permanent magnet 8 such as, for example, a neodymium magnet is fitted in the bearing part 2. Alternatively, the surface of the bearing part 2 at the point where the permanent magnet is fitted can be at least partially magnetized.

As a stop, the lifting clamp 1 has a stop face 9. Furthermore, the bearing part 2 has an edge 11.

Clamping arm 3 is thickened at the end and provided with the clamping face 5, which clamping face is facing the bearing part. If desired, the clamping arm 3 can be pretensioned by means of, for example, a spring 12 in that clamping position, inter alia to hold up the lifting eye 6.

In use, four of these lifting clamps will generally be fitted at the corners of, for example, a square plate and will be provided with chain parts, which meet at a common point and are, for example, fixed there to a lifting hook. For fixing of each of the lifting clamps in such a situation, a person will have to fit each lifting clamp separately and walk round the plate. Owing to the fact that the clamping is generally inadequate before the actual lifting, in other words before the weight of the lifting clamp and the plate rests on the lifting eye 6 thus making the clamping optimal, the lifting clamp can slip off the plate material. This can lead to dangerous situations.

Through the magnet according to the invention, the lifting clamp will automatically adhere better to the plate material. An additional design advantage is that as a result of this, the pretensioning of the clamping action does not have to be so tight. Furthermore, the front side of the bearing part 2 and the clamping arm 3 at clamping face 5 does not have to be made so heavy and large. In addition, the mass beyond the center of gravity, calculated from the point at which the material is clamped, also does not have to be as great. For a proper fixing in clamping work, it was in fact important in the past for the center of gravity of the lifting clamp to be situated beyond the point up to which, for example, plate material extends, in other words beyond the stop 9 in the embodiment shown in the figures.

Furthermore, the magnet in the embodiment shown is fixed between the center of gravity and the edge 11 of the bearing part, so that the natural tendency of the lifting clamp without magnet to rotate about the edge 11 resting against an underside of a plate is prevented by the magnetic forces of the magnet 8. This means that the lifting clamp rests naturally clamped against the plate through the magnetic force and the center of gravity of the lifting clamp and the stop formed by the edge 11 of the bearing part. This is achieved without lifting forces being exerted upon lifting eye 6.

When a load is placed upon the lifting clamp of FIG. 1 in use, clamping arm 3 rotates, with the result that the distance between the bearing part 2 and the clamping face 5 is reduced and a plate to be lifted is clamped. On rotation of clamping arm 3, the clamping face 5 moves towards the stop 9. However, it is also conceivable to have a lifting clamp in which during rotation under load the clamping face actually moves away from the stop and the clamping face is therefore designed in such a way that the distance between the bearing part and the clamping face is reduced and a plate to be lifted is clamped. This embodiment of the lifting clamp is suitable in particular for lifting and transportation of bent or joggled plates.

It should be clear that the above description has been given in order to illustrate the functioning of preferred embodiments of the invention, and not in order to limit the scope of the invention. On the basis of the above explanation, many variations which fall within the spirit and the scope of the present invention will be obvious to a person skilled in the art.

The invention claimed is:

1. A lifting clamp for a workpiece, said lifting clamp comprising:

a bearing part including at least one magnet retained in said bearing part, where the at least one magnet is positioned at or near a center of gravity of said lifting clamp;

an arm extending from said bearing part with a stop face affixed to said arm;

a clamping arm rotatably connected to said arm above said bearing part, said clamping arm at one end is provided with a clamping face engaging a part of the workpiece between the bearing part and the clamping face, and at the other end of the clamping arm is provided with a lifting eye; and a spring urging said clamping arm toward said bearing part.

2. The lifting clamp according to claim 1, wherein said at least one magnet is equipped to hold said lifting clamp in place on an object or plate to be lifted before a lifting force is exerted upon said lifting clamp.

3. The lifting clamp according to claim 1, wherein said at least one magnet is a permanent magnet.

4. The lifting clamp according to claim 1, wherein said at bearing part is at least partially magnetized.

5. The lifting clamp according to claim 1, wherein said clamping arm is rotatable or pivotable about a pivot pin, wherein the pivot pin is mounted on an arm that extends from said bearing part and extends further above said bearing part.

6. A lifting clamp for a workpiece, said lifting clamp comprising:

a bearing part including at least one magnet retained in said bearing part, wherein said at least one magnet is positioned between an edge of said bearing part and a center of gravity of said lifting clamp;

an arm extending from said bearing part with a stop face affixed to said arm;

a clamping arm which is rotatably connected to said arm above said bearing part and at one end is provided with a clamping face for clamping a part of the workpiece between the bearing part and the clamping face, and at the other end of the clamping arm is provided with a lifting eye; and a spring urging said clamping arm toward said bearing part.

7. A method of lifting a workpiece comprising the steps of:

placing a lifting clamp on the workpiece, said lifting clamp comprising:

a bearing part including at least one magnet retained in said bearing part;

an arm extending from said bearing part with a stop face affixed to said arm;

a clamping arm which is rotatably connected to the bearing part above said bearing part and at one end is provided with a clamping face for the purpose of clamping a part of the workpiece between the bearing part and the clamping face, and at the other end of the clamping arm is provided with a lifting eye; and a spring urging said clamping arm toward said bearing part;

holding the lifting clamp in place on the workpiece with the magnet; and exerting a lifting force upon the lifting clamp.

8. The method of claim 7 further comprising placing a second lifting clamp on the workpiece after holding the lifting clamp in place on the workpiece with the magnet but prior to exerting the lifting force upon the lifting clamp, where the second lifting clamp comprises:

a bearing part including at least one magnet; and a clamping arm which is rotatably connected to the bearing part above said bearing part and at one end is provided with a clamping face for the purpose of clamping a part of the workpiece between the bearing part and the clamping face, and at the other end of the clamping arm is provided with a lifting eye.

* * * * *